United States Patent [19]

Asakura

[11] 4,428,124

[45] Jan. 31, 1984

[54] HAIRCUTTING ANGLE INDICATOR

[76] Inventor: Hiromi Asakura, 7-39, 2-chome, Matsushima-cho, Takamatsu-shi, Kagawa, Japan

[21] Appl. No.: 333,617

[22] Filed: Dec. 22, 1981

[51] Int. Cl.[3] ..... B26B 13/22

[52] U.S. Cl. ..... 33/334; 33/186; 33/371; 30/233

[58] Field of Search ..... 33/1 N, 334, 354, 370, 33/371, 372, 373, 391, 399, 186; 30/233

[56] References Cited

U.S. PATENT DOCUMENTS

| | | | |
|---|---|---|---|
| 600,650 | 3/1898 | Powell | 30/233 |
| 3,885,306 | 5/1975 | Herman | 33/334 |
| 4,091,664 | 5/1978 | Zerver | 33/391 |
| 4,215,474 | 8/1980 | Kelley | 30/233 |
| 4,368,745 | 1/1983 | McGuffey | 33/334 |

FOREIGN PATENT DOCUMENTS

| | | | |
|---|---|---|---|
| 322856 | 7/1920 | Fed. Rep. of Germany | 33/373 |
| 607443 | 12/1934 | Fed. Rep. of Germany | 33/371 |
| 149771 | 12/1931 | Switzerland | 33/370 |
| 2559 | of 1801 | United Kingdom | 33/370 |

*Primary Examiner*—Richard R. Stearns

*Attorney, Agent, or Firm*—Wenderoth, Lind & Ponack

[57] ABSTRACT

A hair cutting angle indicator for use with scissors or the like as an aid to cutting the hair at a desired angle with respect to the vertical. It includes an angle gauge mounted on an attachment removably mounted on the scissors. In one embodiment, the indicator holds the scissors at an adjustable desired distance from the head whose hair is being cut. In another embodiment, angular indicia are provided about a bar mounted to the handle of the scissors so as to indicate the angle of the cutting direction about the pivot axis of the scissors.

7 Claims, 8 Drawing Figures

HAIRCUTTING ANGLE INDICATOR

BACKGROUND AND SUMMARY OF THE INVENTION

The present invention relates to a haircutting angle indicator for use with scissors or the like.

Previously, barbers have relied on eye measurement to hold the scissors at a desired angle during haircutting work. This conventional way requires a great deal of skill to perform correctly.

It is an object of the present invention to provide a haircutting angle indicator which is adapted to be mounted on scissors or the like and is very helpful for quick, accurate haircutting.

The haircutting angle indicator according to the present invention are provided with an angle gauge with which the barber can hold the scissors easily at any desired angle. With the invention, haircutting can be expedited and performed correctly.

BRIEF DESCRIPTION OF THE DRAWINGS

With the above-described object in view, the present invention will be more clearly understood from the following detailed description when taken with the accompanying drawings, in which.

In the drawings, like reference numerals denote like parts.

DETAILED DESCRIPTION OF THE PREFERRED EMBODIMENTS

Figure 1:
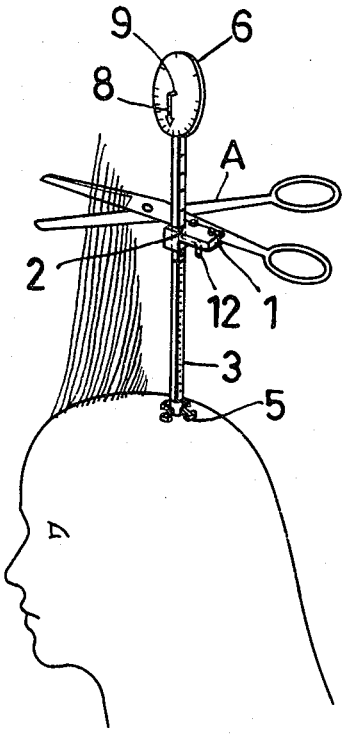
FIG. 1 is a perspective view showing the first embodiment of this invention in use.
Figure 2:
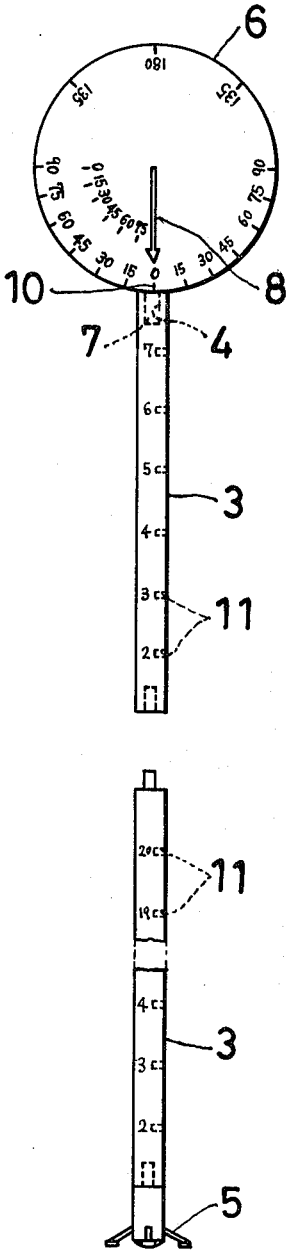
FIG. 2 is a front view of a square bar and an angle gauge used therein.

Referring now to FIGS. 1 and 2, the first embodiment of the present invention includes an attachment 1 removably secured to the handle of the scissors A by means of screws. A square hole 2 is formed in the attachment 1 to receive a square bar 3. The square bar is provided with an axial opening or hollow 4 on one end thereof and with a tripod 5 on the other end. A disk-shaped angle gauge 6 provided with a leg 7 is adapted to rotatably fit in the top hollow 4 in the square bar.

The angle gauge 6 is provided with a needle 8 loosely mounted on a pivot 9 provided in the center thereof. By the force of gravity, the needle 8 is adapted to point vertically downward at all times. The angle gauge 6 is marked with two sets of graduations which indicate angles measured both clockwise and counterclockwise from the zero point 10 in the center.

The square bar 3 is marked with graduations to indicate the height of the scissors from the head when the feet of the tripod 5 is put on the head of a person who is having her hair cut. At the position where each of these graduations is marked, a transverse hole 11 is provided in the square bar 3.

The first embodiment of the present invention further includes a projection 12 which is of an inverted L-shape. When the square bar 3 is mounted in the square hole 2 in the attachment 1, the end of the projection 12 is adapted to fit in one of the holes 11 to determine the height of the scissors.

In use, the square bar 3 is firstly mounted in the square hole 2 in the attachment 1. Then the projection 12 is fitted in one of the holes 11 to prevent rotation of the attachment 1 relative to the square bar 3 and to set the scissors A at a desired height from the head of a person. When a barber wishes to cut the hair at a desired angle during the haircutting work, he has only to incline the scissors A until the needle 8 comes to the desired angle.

Figure 3:
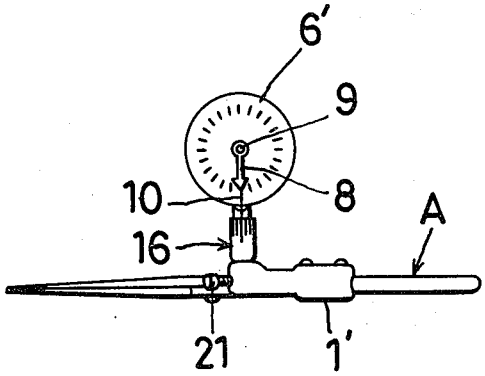
FIG. 3 is a front view of the second embodiment.
Figure 4:
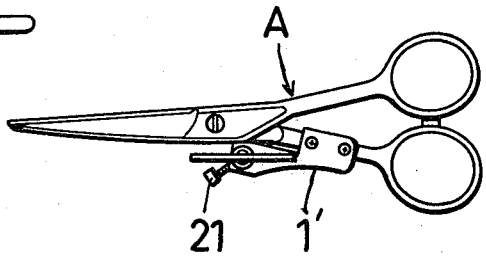
FIG. 4 is a plan view thereof.
Figure 5:
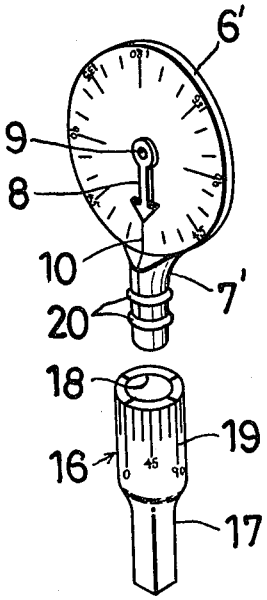
FIG. 5 is an exploded perspective view of an angle gauge and an angle gauge holder used therein.

Referring now to FIGS. 3, 4 and 5, the second embodiment of the present invention differs from the first one in that the angle gauge 6' is mounted on the haircutting scissors A by means of an angle gauge holder 16, which is provided with a square-headed portion 17 on one end and with an opening or hollow 18 on the other end. On the latter end, the angle gauge holder 16 is marked with graduations 19 which represent angles measured in both directions from a zero point and provide an indication of the angle of the cutting direction about the pivot axis of the scissors. The zero point 10 on the angle gauge extends downwardly into an extension line. The square-headed portion 17 is adapted to fit in the square hole 2' in the attachment 1'. Rubber bands 20 fit on the leg 7' of the angle gauge 6'. The leg with the rubber bands is adapted to fit in the hollow 18 in the holder 16.

The second embodiment of the present invention still further differs from the first one in that on both sides of the angle gauge 6' are provided a needle 8 and graduations.

In use of the second embodiment, the square-headed portion 17 of the angle gauge holder 16 is mounted in the square hole 2' in the attachment 1'. Then a setscrew 21 is tightened to fasten the angle gauge holder 16. Then the leg 7' of the angle gauge 6' is put in the hollow 18 in the angle gauge holder 16. As long as excessive turning force is not applied to the angle gauge 6', movement of the angle gauge relative to the angle gauge holder 16 is prevented by friction caused by the rubber bands 20.

Figure 6:
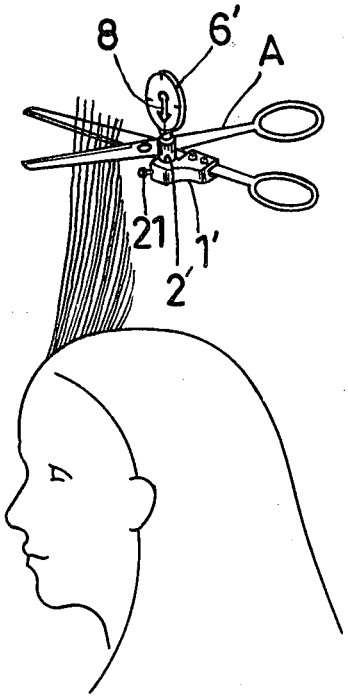
FIGS. 6 and 7 are perspective views showing the second embodiment in use.

FIG. 6 shows a case where a barber holds the scissors A with the angle gauge 6' disposed above the scissors.

Figure 7:
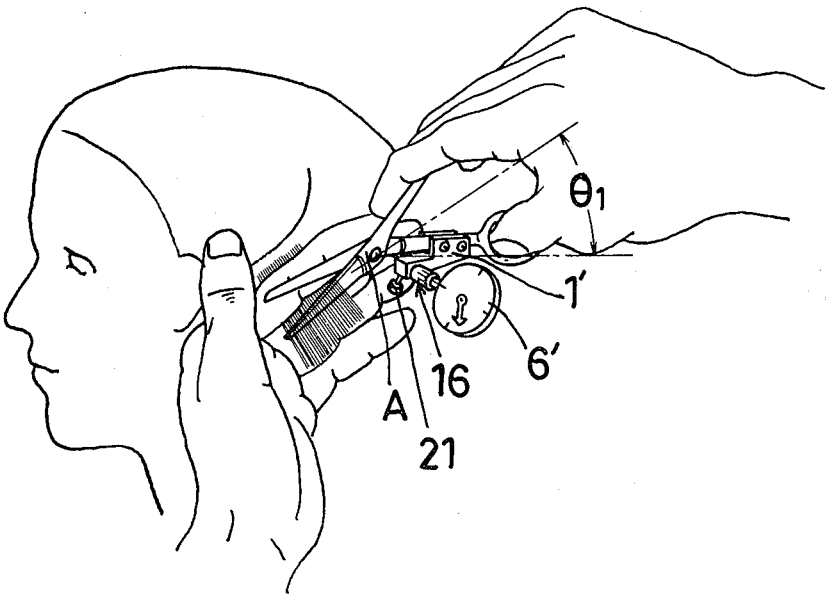
Figure 8:
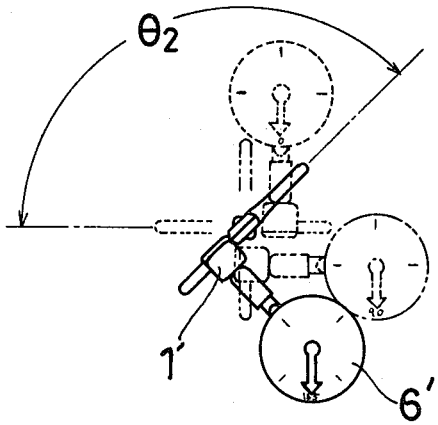
FIG. 8 is a view showing how the angle is indicated when the hand holding the scissors is twisted.

FIG. 7 shows how the hair is cut obliquely downward or upward at a desired angle $\theta_1$ and $\theta_2$. Firstly the scissors A is held so that the graduation 19 on the angle gauge holder 16 points the desired angle $\theta_1$ (e.g. 45°). Then the scissors is gradually inclined to an angle of $\theta_1$ on the angle gauge with the holder 16 at a horizontal position and the angle gauge at a vertical position. Further, the hand is twisted so that the needle 8 on the angle gauge 6' will point to an angle $\theta_2$ (e.g. 135°). Now the scissors will be at the desired position.

If a barber looks askance at the scissors A while haircutting, the angle gauge 6' can be turned about the axis of the leg 7' until the extension line from the zero point comes to such a graduation on the holder that he can see the angle gauge easily. The indicator of the present invention may be used with a haircutting razor as well as with scissors.

While two embodiments of the present invention have been disclosed, it is to be understood that they are described by way of example only and not in a limiting sense, various other modifications being apparent from the above description.

What I claim is:

1. A hair-cutting angle and distance indicator for use with scissors while cutting hair on a person's head, comprising:

an elongated bar having a first end for engaging the head and a second end opposite said first end;

an angle gauge including a circular dial having angular indicia marked thereon in a plane parallel to the length of said bar, and a needle freely rotatably mounted to said dial for rotation about an axis perpendicular to said plane along said indicia such that said needle is drawn by gravity into a generally vertical orientation, said gauge being mounted to said second end of said bar; and means for mounting the scissors to said bar so as to be movable therealong between said first and second ends such that the scissors are usable to cut hair at a desired distance from the head, said needle hanging vertically downward so as to indicate the angle of cutting by the scissors with respect to the vertical.

2. An indicator as in claim 1, further comprising indicia longitudinally formed along said bar so as to indicate the distance of said means and the scissors from the head from which hair is to be cut, said means including an attachment for holding the handle of the scissors, said attachment having a hole therein for receiving said bar, said attachment being slidable along said bar so as to adjust the distance of the scissors from the head.

3. An indicator as in claim 1, further comprising holes formed in said bar along its length, and said attachment including means for removably engaging said holes so as to hold said scissors at a desired distance from the head.

4. An indicator as in claim 3, further comprising a tripod fixed to said first end of said bar for engaging the head of the person whose hair is to be cut.

5. An indicator as in claim 3, wherein said bar has a noncircular cross section.

6. A hair cutting indicator for attachment to a scissors having cutting edges which pivot about a pivot axis and mate along a cutting direction, comprising:

a longitudinally extending member having a first end and and a second end, and having first angular indicia thereon formed about the longitudinal axis thereof indicative of the angle of the cutting direction about the pivot axis;

an angle gauge for indicating the angle of the cutting direction with respect to the vertical, including a circular dial having second angular indicia thereon in a plane and a needle freely rotatably mounted for rotation about an axis of rotation perpendicular to said plane along said second indicia so as to be drawn by gravity into a generally vertical orientation, said gauge being mounted to said first end of said member such that said axis of rotation is perpendicular to said longitudinal axis, and means for mounting said member to the handle of the scissors.

7. A hair cutting indicator as in claim 6, wherein said means includes an attachment removably mountable to the handle of the scissors, having a hole therein for attaching said gauge thereto at said second end of said member, with said longitudinal axis of said member extending parallel to the pivot axis of the scissors.

* * * * *